US009119242B2

(12) United States Patent
Lv et al.

(10) Patent No.: US 9,119,242 B2
(45) Date of Patent: Aug. 25, 2015

(54) SYSTEMS AND METHODS FOR PROVIDING POWER TO HIGH-INTENSITY-DISCHARGE LAMPS

(71) Applicant: ON-BRIGHT ELECTRONICS (SHANGHAI) CO., LTD., Shanghai (CN)

(72) Inventors: Huawei Lv, Shanghai (CN); Dongze Yang, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/220,040

(22) Filed: Mar. 19, 2014

(65) Prior Publication Data

US 2014/0203731 A1 Jul. 24, 2014

Related U.S. Application Data

(62) Division of application No. 13/527,481, filed on Jun. 19, 2012.

(30) Foreign Application Priority Data

May 17, 2012 (CN) ..... 2012 1 0166683

(51) Int. Cl.
*H05B 37/02* (2006.01)
*H05B 41/04* (2006.01)

(52) U.S. Cl.
CPC ..... *H05B 37/02* (2013.01); *H05B 41/042* (2013.01)

(58) Field of Classification Search
CPC ..... H05B 37/02; H05B 41/2882; H05B 41/2928; H05B 41/38; H05B 41/3921
USPC ..... 315/209 R, 210, 224–226, 246, 247, 315/291, 294, 297, 307, 308, 312, 360
See application file for complete search history.

(56) References Cited

U.S. PATENT DOCUMENTS 5,828,177 A 10/1998 Toda et al.
6,008,590 A * 12/1999 Giannopoulos et al. .. 315/209 R (Continued)

FOREIGN PATENT DOCUMENTS

CN 1695404 A 11/2005
CN 1954646 A 4/2007
CN 101742791 A 6/2010

OTHER PUBLICATIONS

Chinese Patent Office, Office Action mailed Jan. 6, 2015, in Application No. 201210166683.9.

(Continued)

*Primary Examiner* — Tung X Le
(74) *Attorney, Agent, or Firm* — Jones Day

(57) ABSTRACT

System and method for igniting one or more high-intensity-discharge lamps. A system includes an ignition controller configured to generate one or more signal pulses for a pulse signal during a first predetermined time period and to cause one or more voltage pulses to be applied to the one or more high-intensity-discharge lamps, the pulse signal changing between a first logic level and a second logic level during the first predetermined time period, each of the one or more signal pulses corresponding to a pulse period, the pulse period being no larger than the first predetermined time period. The ignition controller is further configured to, if the one or more high-intensity-discharge lamps are not successfully ignited after the first predetermined time period, stop generating any signal pulse for the pulse signal for a second predetermined time period, the second predetermined time period being equal to or larger than the pulse period.

23 Claims, 6 Drawing Sheets

(56) References Cited

U.S. PATENT DOCUMENTS

| | | | | |
|---|---|---|---|---|
| 6,362,575 | B1 * | 3/2002 | Chang et al. | 315/224 |
| 6,958,580 | B2 * | 10/2005 | Kamoi et al. | 315/291 |
| 2004/0212318 | A1 * | 10/2004 | Hamamoto et al. | 315/200 R |
| 2004/0251852 | A1 * | 12/2004 | Kambara et al. | 315/291 |
| 2007/0080651 | A1 | 4/2007 | Hu et al. | |
| 2007/0138975 | A1 | 6/2007 | Suganuma et al. | |
| 2010/0156312 | A1 | 6/2010 | Yufuku et al. | |
| 2010/0253234 | A1 | 10/2010 | Hu et al. | |
| 2011/0187288 | A1 | 8/2011 | Horikawa et al. | |

OTHER PUBLICATIONS

United States Patent and Trademark Office, Office Action mailed Apr. 17, 2014 in U.S. Appl. No. 13/527,481.

United States Patent and Trademark Office, Office Action mailed Dec. 2, 2014 in U.S. Appl. No. 13/527,481.

United States Patent and Trademark Office, Notice of Allowance mailed Apr. 14, 2015 in U.S. Appl. No. 13/527,481.

* cited by examiner

SYSTEMS AND METHODS FOR PROVIDING POWER TO HIGH-INTENSITY-DISCHARGE LAMPS

CROSS-REFERENCES TO RELATED APPLICATIONS

This application is a divisional of U.S. patent application Ser. No. 13/527,481, filed Jun. 19, 2012, which claims priority to Chinese Patent Application No. 201210166683.9, filed May 17, 2012, both applications being incorporated by reference herein for all purposes.

BACKGROUND OF THE INVENTION

The present invention is directed to integrated circuits. More particularly, the invention provides systems and methods for providing power to high-intensity-discharge lamps. Merely by way of example, the invention has been applied for igniting and driving high-intensity-discharge lamps. But it would be recognized that the invention has a much broader range of applicability.

High-Intensity-Discharge (HID) lamps often have high brightness, and provide excellent color rendering. In addition, HID lamps usually enhance visual comfort, and reduce eye fatigue. Because HID lamps do not use incandescent filaments, HID lamps often have a longer lifetime than incandescent lamps.

FIG. 1 is a simplified diagram showing a conventional system 100 for driving an HID lamp 102. The system 100 includes a boost power-factor-corrected (PFC) stage 104, a Buck stage 106, and a full-bridge stage 108. The boost PFC stage 104 includes an inductor 110, a transistor 112, a diode 114, and a capacitor 116. The Buck stage 106 includes a switch 118, a diode 120, an inductor 122, and a resistor 124. The full-bridge stage 108 includes four transistors 126, 128, 130 and 132, a capacitor 134 and two inductors 136 and 138. For example, a chip ground voltage 154 is different from an external ground voltage 158, and a voltage drop 156 on the resistor 124 represents the difference between the chip ground voltage 154 and the external ground voltage 158.

The boost PFC stage 104 outputs a signal 150 to the Buck stage 106. The full-bridge stage 108 receives a signal 152 from the Buck stage 106 for driving the HID lamp 102. The system 100 often has many disadvantages, such as complex circuits, high cost, large short-circuit power consumption, and inadequate protection.

Hence, it is highly desirable to improve techniques for driving (e.g., igniting and/or regulating) an HID lamp.

BRIEF SUMMARY OF THE INVENTION

The present invention is directed to integrated circuits. More particularly, the invention provides systems and methods for providing power to high-intensity-discharge lamps. Merely by way of example, the invention has been applied for igniting and driving high-intensity-discharge lamps. But it would be recognized that the invention has a much broader range of applicability.

According to one embodiment, a system for igniting one or more high-intensity-discharge lamps includes an ignition controller configured to generate one or more signal pulses for a pulse signal during a first predetermined time period and to cause one or more voltage pulses to be applied to the one or more high-intensity-discharge lamps, the pulse signal changing between a first logic level and a second logic level during the first predetermined time period, each of the one or more signal pulses corresponding to a pulse period, the pulse period being no larger than the first predetermined time period. The ignition controller is further configured to, if the one or more high-intensity-discharge lamps are not successfully ignited after the first predetermined time period, stop generating any signal pulse for the pulse signal for a second predetermined time period, the second predetermined time period being equal to or larger than the pulse period.

According to another embodiment, a system for igniting one or more high-intensity-discharge lamps includes an ignition controller and a logic controller. The ignition controller is configured to generate one or more signal pulses for a pulse signal during a first predetermined time period and to cause one or more voltage pulses to be applied to the one or more high-intensity-discharge lamps, the pulse signal changing between a first logic level and a second logic level during the first predetermined time period, each of the one or more signal pulses corresponding to a pulse period, the pulse period being no larger than the first predetermined time period. The logic controller is configured to generate one or more direction pulses for a direction signal during the first predetermined time period to change a direction for a current associated with the one or more high-intensity-discharge lamps, the direction signal changing between a third logic level and a fourth logic level during the first predetermined time period. The direction signal changes from the third logic level to the fourth logic level at the same time as the pulse signal changes from the second logic level to the first logic level. The direction signal changes from the fourth logic level to the third logic level at the same time as the pulse signal changes from the second logic level to the first logic level.

According to yet another embodiment, a system for driving one or more high-intensity-discharge lamps includes a regulation component and a controller component. The regulation component is configured to receive an input signal indicating a power associated with the one or more high-intensity-discharge lamps and generate a first signal based on at least information associated with the input signal. The controller component is configured to receive the first signal and a second signal indicating a voltage associated with the one or more high-intensity-discharge lamps. The regulation component is further configured to generate an output signal based on at least information associated with the first signal and the second signal in order to adjust a current associated with the one or more high-intensity-discharge lamps.

According to yet another embodiment, a system for driving one or more high-intensity-discharge lamps includes a logic component and a controller component. The logic component is configured to output a direction signal to change a direction for a current associated with the one or more high-intensity-discharge lamps and to output a modulation signal associated with a plurality of on-time periods. The controller component is configured to receive at least the direction signal and generate an output signal to the logic component based on at least information associated with the direction signal. Further, if the direction signal changes from a first logic level to a second logic level at a first time, the logic component is further configured to change the modulation signal based on at least information associated with the output signal to adjust one or more on-time periods after the first time, the one or more on-time periods after the first time increasing in duration over time.

In one embodiment, a method for igniting one or more high-intensity-discharge lamps includes generating one or more signal pulses for a pulse signal during a first predetermined time period, the pulse signal changing between a first logic level and a second logic level during the first predetermined time period, each of the one or more signal pulses corresponding to a pulse period, the pulse period being no larger than the first predetermined time period. The method further includes processing information associated with the one or more signal pulses for the pulse signal, causing one or more voltage pulses to be applied to the one or more high-intensity-discharge lamps, and if the one or more high-intensity-discharge lamps are not successfully ignited after the first predetermined time period, stopping generating any signal pulse for the pulse signal for a second predetermined time period, the second predetermined time period being equal to or larger than the pulse period.

In another embodiment, a method for igniting an ignition one or more high-intensity-discharge lamps includes generating one or more signal pulses for a pulse signal during a first predetermined time period, the pulse signal changing between a first logic level and a second logic level during the first predetermined time period, each of the one or more signal pulses corresponding to a pulse period, the pulse period being no larger than the first predetermined time period. The method further includes causing one or more voltage pulses to be applied to the one or more high-intensity-discharge lamps, and generating one or more direction pulses for a direction signal during the first predetermined time period to change a direction for a current associated with the one or more high-intensity-discharge lamps, the direction signal changing between a third logic level and a fourth logic level during the first predetermined time period. Additionally, the method includes changing the pulse signal from the second logic level to the first logic level at the same time as the direction signal changes from the third logic level to the fourth logic level, and changing the pulse signal from the second logic level to the first logic level at the same time as the direction signal changes from the fourth logic level to the third logic level.

In yet another embodiment, a method for driving one or more high-intensity-discharge lamps includes receiving an input signal indicating a power associated with the one or more high-intensity-discharge lamps, processing information associated with the input signal, and generating a first signal based on at least information associated with the input signal. The method further includes receiving the first signal and a second signal indicating a voltage associated with the one or more high-intensity-discharge lamps, processing information associated with the first signal and the second signal, and generating an output signal based on at least information associated with the first signal and the second signal in order to adjust a current associated with the one or more high-intensity-discharge lamps.

In yet another embodiment, a method for driving one or more high-intensity-discharge lamps includes generating a direction signal to change a direction for a current associated with the one or more high-intensity-discharge lamps, generating a modulation signal associated with a plurality of on-time periods, and receiving at least the direction signal. In addition, the method includes processing information associated with the direction signal, generating an output signal based on at least information associated with the direction signal, and if the direction signal changes from a first logic level to a second logic level at a first time, changing the modulation signal based on at least information associated with the output signal to adjust one or more on-time periods after the first time, the one or more on-time periods after the first time increasing in duration over time.

Depending upon embodiment, one or more of these benefits may be achieved. These benefits and various additional objects, features and advantages of the present invention can be fully appreciated with reference to the detailed description and accompanying drawings that follow.

DETAILED DESCRIPTION OF THE INVENTION

The present invention is directed to integrated circuits. More particularly, the invention provides systems and methods for providing power to high-intensity-discharge lamps. Merely by way of example, the invention has been applied for igniting and driving high-intensity-discharge lamps. But it would be recognized that the invention has a much broader range of applicability.

Figure 1:
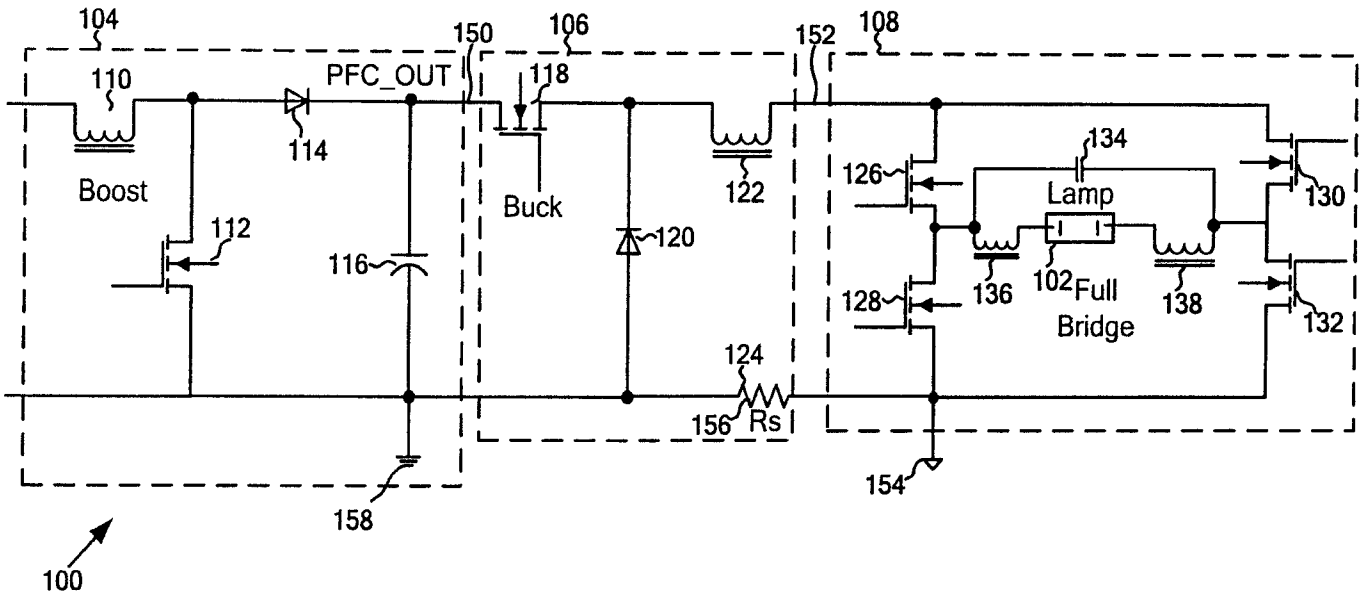
Fig. 1 (Prior Art)
FIG. 1 is a simplified diagram showing a conventional system for driving an HID lamp.
Figure 2:
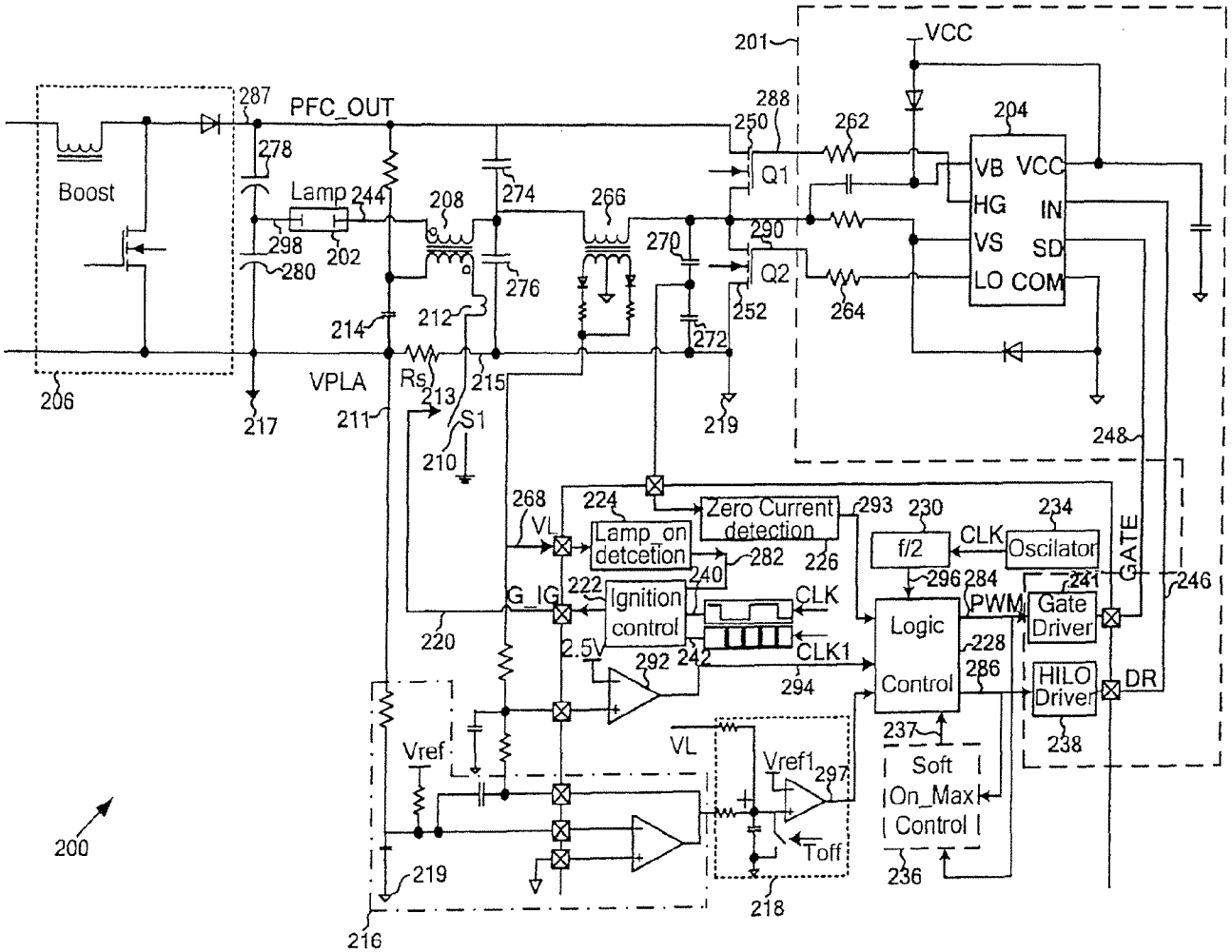
FIG. 2 is a simplified diagram showing a system for driving an HID lamp according to an embodiment of the present invention.

FIG. 2 is a simplified diagram showing a system 200 for driving an HID lamp according to an embodiment of the present invention. This diagram is merely an example, which should not unduly limit the scope of the claims. One of ordinary skill in the art would recognize many variations, alternatives, and modifications.

The system 200 includes a regulation driver 201, a boost PFC stage 206, a lamp-power-regulation component 216, an on-time control component 218, a switch 210, an inductor 212, a transformer 208, an inductive component 266, two transistors 250 and 252, a current sensing resistor 213, a logic control component 228, a soft-on-time-max control component 236, an ignition control component 222, a current detection component 226, an oscillator 234, a signal generator 230, a lamp-on detection component 224, a comparator 292, and capacitors 214, 270, 272, 274, 276, 278 and 280. The regulation driver 201 includes a controller 204, resistors 262, 264, a current-reversal control component 238, and a gate driver 241.

Figure 3:
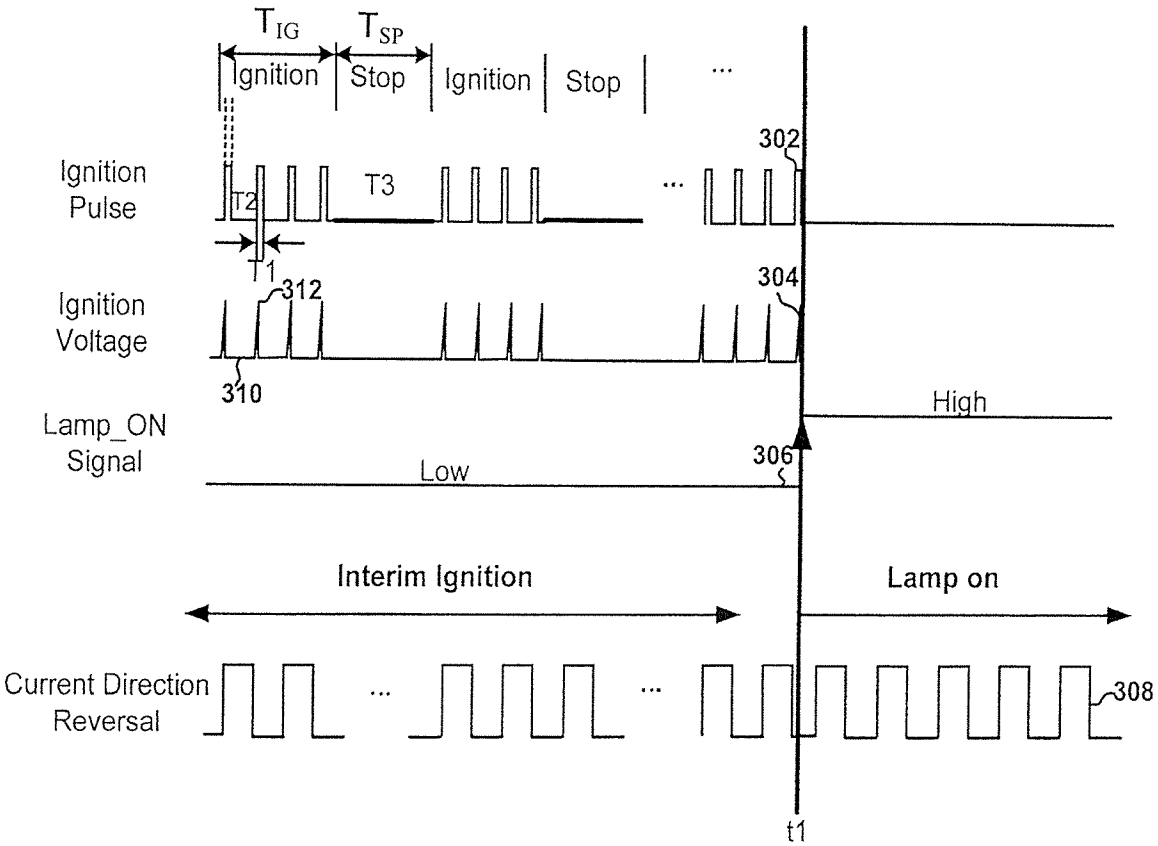
FIG. 3 is a simplified timing diagram for the system shown in FIG. 2 according to an embodiment of the present invention.

FIG. 3 is a simplified timing diagram for the system 200 according to an embodiment of the present invention. This diagram is merely an example, which should not unduly limit the scope of the claims. One of ordinary skill in the art would recognize many variations, alternatives, and modifications.

The waveform 302 represents an ignition pulse signal 220 generated by the ignition control component 222 as a function of time. The waveform 304 represents an ignition voltage 244 of the HID lamp 202 as a function of time. The waveform 306 represents a lamp-on signal 282 generated by the lamp-on detection component 224 as a function of time. In addition, the waveform 308 represents a current-reversal signal 246 generated by the current-reversal control component 238 as a function of time.

According to one embodiment, as shown in FIG. 2, the ignition control component 222 receives two pulse signals 240 and 242 and a detection signal 282 that indicates whether the lamp 202 has been successfully ignited, and outputs an ignition pulse signal 220 for igniting the HID lamp 202 if the lamp 202 has not been successfully ignited. For example, as shown in FIG. 3, the ignition pulse signal 220 has an operation period which includes an ignition time period (e.g., $T_{IG}$) and a cooling time period (e.g., $T_{SP}$). In another example, during the ignition time period (e.g., $T_{IG}$), the switch 210 is turned on (e.g., during a pulse period $T_1$) or off (e.g., during a no-pulse period $T_2$) repeatedly in order to ignite the lamp 202. In yet another example, when the switch 210 is open (e.g., off) during the no-pulse period $T_2$, the boost PFC stage 206 outputs a voltage signal 287 to charge the capacitor 214. In yet another example, after the capacitor 214 is charged fully (e.g., the voltage of the capacitor 214 reaches a threshold), the switch 210 is closed (e.g., on) during the pulse period $T_1$. Then, an LC resonant circuit including the capacitor 214 and the inductor 212 begins to operate and energy stored in the capacitor 214 is transferred to the inductor 212 so that resonance in the LC circuit occurs and generates a very high voltage, according to certain embodiments.

According to another embodiment, as shown in FIG. 2, the voltage of the inductor 212 is coupled through the transformer 208 to generate an ignition voltage 244 for the lamp 202. For example, the ignition voltage 244 keeps at a low value 310 (e.g., zero) during the no-pulse period $T_2$, and increases (e.g., linearly or non-linearly) to a large magnitude 312 during the pulse period $T_1$ in order to ignite the lamp 202 (e.g., to strike through the gas or vapor in the lamp 202) as shown by the waveform 304. In another example, if the lamp 202 is not successfully ignited, the LC resonance dampens. In yet another example, when the LC resonant voltage reduces to zero, the ignition pulse signal 220 changes to a logic low level (e.g., an ignition pulse passes), and the switch 210 is open (e.g., off) again. In yet another example, a next cycle starts and the capacitor 214 is charged again during a no-pulse period. In yet another example, if at the end of the ignition time period $T_{IG}$, the lamp 202 is still not successfully ignited, then the cooling time period $T_{SP}$ starts. In yet another example, the ignition pulse signal 220 keeps at the logic low level (e.g., no ignition pulses generated) and the lamp 202 cools down. In yet another example, after the cooling time period $T_{SP}$, a next ignition time period starts for another attempt to ignite the lamp 202 until the lamp 202 is successfully ignited (e.g., at $t_1$), as shown by the waveform 302. In yet another example, the pulse period (e.g., $T_1$) is no larger than the ignition time period (e.g., $T_{IG}$). In yet another example, a sum of the pulse period (e.g., $T_1$) and the non-pulse period (e.g., $T_2$) is no larger than the ignition time period (e.g., $T_{IG}$). In yet another example, the cooling time period (e.g., $T_{SP}$) is equal or larger than the pulse period (e.g., $T_1$). In yet another example, the cooling time period (e.g., $T_{SP}$) is equal or larger than the sum of the pulse period (e.g., $T_1$) and the non-pulse period (e.g., $T_2$).

According to yet another embodiment, once successfully ignited, the lamp 202 becomes nearly short-circuited, and the lamp voltage 244 changes to a low magnitude (e.g., nearly 0 V). For example, the lamp-on detection component 224 receives a signal 268 that indicates the lamp voltage 244, and changes the lamp-on signal 282 from a logic low level to a logic high level (e.g., at $t_1$ as shown by the waveform 306). In another example, in response, the ignition control component 222 changes the ignition pulse signal 220 to the logic low level and keeps the ignition pulse signal 220 at the logic low level (e.g., no ignition pulses being generated as shown by the waveform 302). Then, the ignition process is completed according to certain embodiments.

Because of the physical properties of the HID lamp 202, the current 298 that flows through the lamp 202 needs to change directions at a certain frequency (e.g., 100-400 Hz) in some embodiments. For example, the logic control component 228 receives a detection signal 293 from the current-detection component 226, a comparison signal 294 from the comparator 292, a control signal 297 from the on-time control component 218, an on-time-max signal 237 from the soft-on-time-max control component 236, and a signal 296 from the signal generator 230. In another example, the logic control component 228 outputs a signal 286 to the current-reversal control component 238 which generates a current-reversal signal 246. In yet another example, the logic control component 228 outputs a signal 284 to the gate driver 241 which generates a gate drive signal 248. In yet another example, the controller 204 receives the current-reversal signal 246 and the gate drive signal 248 and generates signals for driving the transistors 250 and 252. In yet another example, the transistors 250 and 252 operate alternately in response to signals 288 and 290 respectively. In yet another example, when the transistor 250 operates (e.g., being turned on or off), the transistor 252 is turned off and the current 298 flows in one direction (e.g., from the transformer 208 to the lamp 202). In yet another example, when the transistor 252 operates (e.g., being turned on or off), the transistor 250 is turned off and the current 298 changes its direction (e.g., flows from the lamp 202 to the transformer 208). In yet another example, the gate drive signal 248 affects an on-time period (e.g., Ton) and an off-time period (e.g., Toff) of the transistor 250 or the transistor 252. In yet another example, during the on-time period (e.g., Ton) of the transistor 250, the transistor 250 is on, and during the off-time period (e.g., Toff) of the transistor 250, the transistor 250 is off. In yet another example, during the on-time period (e.g., Ton) of the transistor 252, the transistor 252 is on, and during the off-time period (e.g., Toff) of the transistor 252, the transistor 252 is off.

In one embodiment, during the ignition time period (e.g., $T_{IG}$), the current-reversal signal 246 changes between a logic high level and a logic low level (e.g., as shown by the waveform 308). For example, when the current-reversal signal 246 changes from the logic high level to the logic low level or from the logic low level to the logic high level, the controller 204 changes the signals 288 and 290 to drive the transistor 250 or the transistor 252. The ignition pulse signal 220 is synchronized with the current-reversal signal 246 to improve the success rate of the ignition in some embodiments. For example, an ignition pulse is generated for the ignition pulse signal 220 at the same time as the current-reversal signal 246 changes from the logic high level to the logic low level or from the logic low level to the logic high level (e.g., as shown by the waveforms 302 and 308). In another example, each pulse in the ignition pulse signal 220 corresponds to a change of logic levels of the current-reversal signal 246. In yet another example, during the cooling time period (e.g., $T_{SP}$), the current-reversal signal 246 changes between the logic high level and the logic low level. In yet another example, during the cooling time period (e.g., $T_{SP}$), the current-reversal signal 246 does not change between the logic high level and the logic low level. In yet another example, after the lamp 202 is successfully ignited (e.g., at $t_1$), the current-reversal signal 246 continues to change between the logic high level and the logic low level (e.g., as shown by the waveform 308) in order to change the direction of the current 298.

Figure 4:
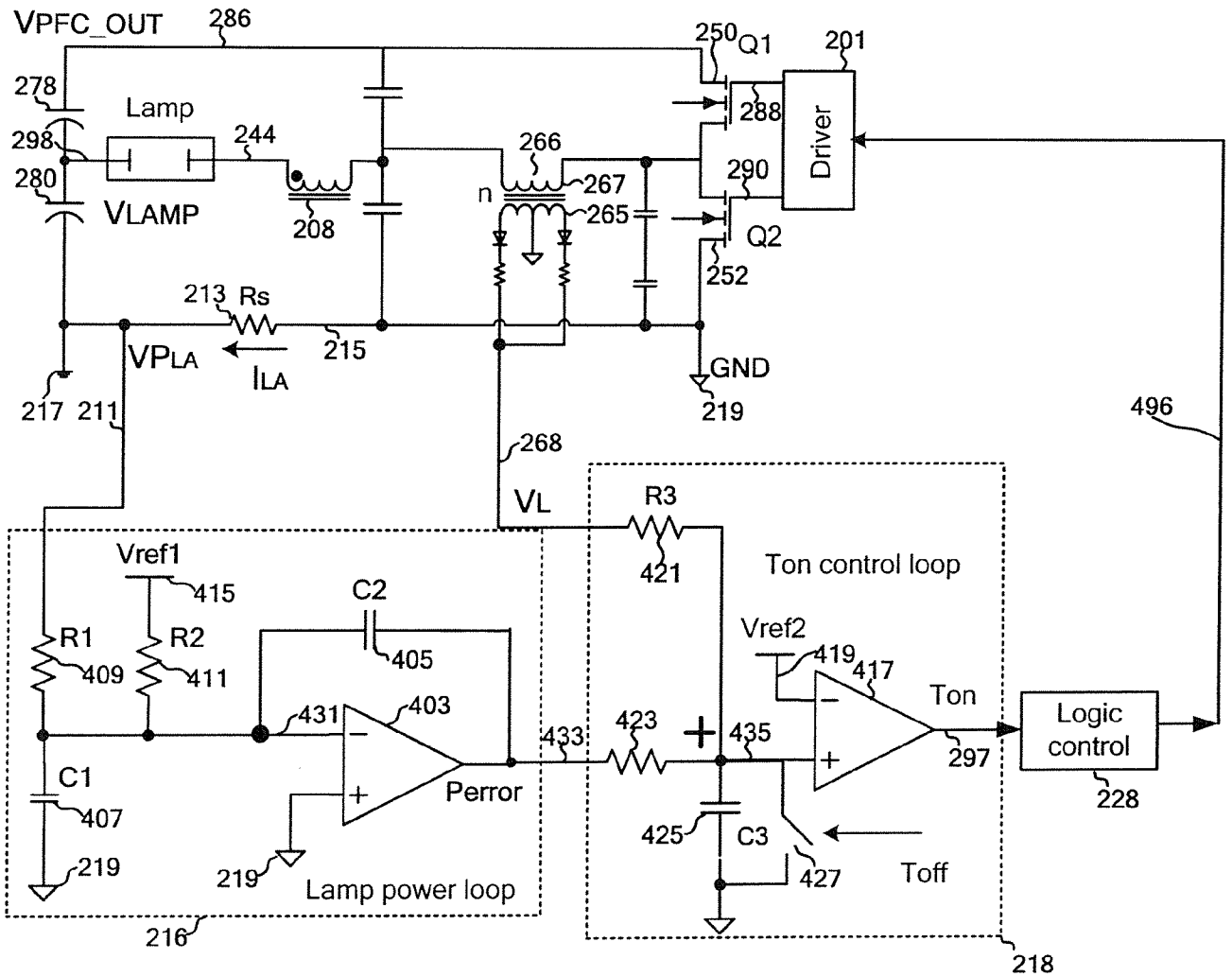
FIG. 4 is a simplified diagram showing certain components of the system shown in FIG. 2 for lamp power regulation after successful ignition according to an embodiment of the present invention.

FIG. 4 is a simplified diagram showing certain components of the system 200 for lamp power regulation after successful ignition according to an embodiment of the present invention. This diagram is merely an example, which should not unduly limit the scope of the claims. One of ordinary skill in the art would recognize many variations, alternatives, and modifications.

As shown in FIG. 4, the lamp-power-regulation component 216 includes an amplifier 403, two capacitors 405 and 407, and two resistors 409 and 411. The on-time control component 218 includes an amplifier 417, two resistors 421 and 423, a capacitor 425 and a switch 427. The inductive component 266 includes a primary winding 267 and a secondary winding 265. For example, a chip ground voltage 219 is different from an external ground voltage 217.

After the lamp 202 is successfully ignited, the current 298 that flows through the lamp 202 needs to change directions at a particular frequency (e.g., 100-400 Hz) in some embodiments. For example, the on-time control component 218 outputs the control signal 297 which is received by the logic control component 228. In another example, the logic control component 228 outputs a signal 496 to the regulation driver 201 which in response generates the signals 288 and 290 to drive the transistors 250 and 252, respectively. In yet another example, the signal 496 includes one or both of the signals 284 and 286. In yet another example, the transistors 250 and 252 operate alternately in response to the signals 288 and 290 respectively. In yet another example, the transistor 250 and the transistor 252 each have an on-time period (e.g., $T_{on}$) and an off-time period (e.g., $T_{off}$). In yet another example, during the on-time period of the transistor 250 or the transistor 252, the current 298 increases in magnitude.

Because the boost PFC stage 206 provides power for the HID lamp 202, the lamp power is kept at a certain level if the output power of the boost PFC stage 206 is regulated to be constant, according to certain embodiments. For example, the boost PFC stage 206 provides the output voltage 287 which is nearly constant, and hence the output current of the boost PFC stage 206 may indicate the output power of the boost PFC stage 206 and the input power of the lamp 202. In another example, the lamp-power-regulation component 216 receives a signal 211 (e.g., $V_{PLA}$) that indicates the output current of the boost PFC stage 206 (e.g., a DC-bus current). For example, the signal 211 (e.g., $V_{PLA}$) is determined according to the following equation:

$$V_{PLA}=I_{LA}\times R_S \quad \text{(Equation 1)}$$

where $R_S$ represents the resistance of the current sensing resistor 213 and $I_{LA}$ represents a current 215 that flows through the current sensing resistor 213. In another example, an average value of the signal 211 is determined based on an average value of the current 215.

$$V_{PLA_avg}=I_{LA_avg}\times R_S \quad \text{(Equation 2)}$$

where $I_{LA_avg}$ represents the average value of the current 215 that flows through the current sensing resistor 213 and $V_{PLA_avg}$ represents the average value of the signal 211.

In one embodiment, the lamp power is determined according to the following equation:

$$\text{Power_}L=V_{PFC_OUT}\times|I_{LA_avg}|\times\eta \quad \text{(Equation 3)}$$

where Power_L represents the lamp power of the lamp 202, $V_{PFC_OUT}$ represents the output voltage 287 of the boost PFC stage 206, and $\eta$ is the efficiency of the power conversion system 200. For example, $\eta$ is close to 1. In another example, Equation 3 is simplified as follows:

$$\text{Power_}L\approx V_{PFC_OUT}\times|I_{LA_avg}| \quad \text{(Equation 4)}$$

In yet another example, the lamp power is determined according to the following equation:

$$\text{Power_L}\approx V_{PFC_OUT}\times\left|\frac{V_{PLA_avg}}{R_S}\right| \quad \text{(Equation 5)}$$

In yet another example, the output voltage 287 of the boost PFC stage 206 is kept nearly constant. In yet another example, if the average value of the current 215 is regulated to be approximately a predetermined value, the average value of the signal 211 is kept at approximately a particular value. Thus, the lamp power is regulated to be almost constant at a predetermined level according to certain embodiments.

In another embodiment, after the lamp 202 is successfully ignited, the amplifier 403 receives a voltage signal 431 at an inverting terminal, and the chip-ground voltage 219 at a non-inverting terminal. For example, the voltage signal 431 is generated based on at least information associated with the signal 211 (e.g., $V_{PLA}$), the chip ground voltage 219, and a reference signal 415. In another example, a difference between the signal 431 and the chip-ground voltage 219 is integrated using at least the amplifier 403 (e.g., as part of an error amplifier). In yet another example, the amplifier 403 outputs a signal 433 to the on-time control component 218.

In yet another embodiment, if the switch 427 is open (e.g., off), the capacitor 425 is charged in response to the signal 433. For example, the amplifier 417 receives a signal 435 at a non-inverting terminal and a reference signal 419 at an inverting terminal, and outputs the control signal 297 which affects the on-time period (e.g., $T_{on}$) of the transistor 250 or the transistor 252 in order to regulate the lamp current 298. In another example, the reference signal 419 is the same as or different from the reference signal 415 that is received by the lamp-power-regulation component 216. In yet another example, the signal 435 is related to a combination of a voltage generated from charging the capacitor 425 and the signal 268 (e.g., $V_L$) which is associated with the inductive component 266. In yet another example, the signal 268 (e.g., $V_L$) is related to a current flowing through the secondary winding 265 of the inductive component 266. In yet another example, the signal 268 (e.g., $V_L$) is determined based on the following equation:

$$n\times V_L+V_{lamp}=\frac{V_{PFC_out}}{2} \quad \text{(Equation 6)}$$

where $V_L$ represents the signal 268, n represents a turns ratio between the primary winding 267 and the secondary winding 265 of the inductive component 266, $V_{lamp}$ represents the lamp voltage 244, and $V_{PFC_out}$ represents the output voltage 287 of the boost PFC stage 206. In yet another example, the output voltage 287 (e.g., $V_{PFC_out}$) is nearly constant, and thus the signal 268 (e.g., $V_L$) is used to indicate the lamp voltage 244.

$$V_{lamp}=\frac{V_{PFC_out}}{2}-n\times V_L \quad \text{(Equation 7)}$$

In yet another embodiment, shortly after the lamp 202 is successfully ignited, the lamp voltage 244 has a very low magnitude (e.g., nearly zero), and the lamp power has not reached a threshold. For example, the duration of the on-time period (e.g., $T_{on}$) of the transistor 250 or the transistor 252 would be increased to a maximum value (e.g., $T_{on_max}$), and the lamp current 298 increases to a large magnitude in order for the lamp power to reach the threshold. In another example, if the lamp current 298 goes beyond a limit, the lifetime of the lamp 202 may be negatively affected and the current stress on the transistor 250 and/or the transistor 252 may be increased. Thus, during the process of increasing the lamp voltage 244 after successful ignition, the lamp current 298 needs to be regulated in some embodiments. For example, the lamp current 298 is determined according to the following equation:

$$\frac{V_L}{L} \times T_{on} = I_{peak} \quad \text{(Equation 8)}$$

where $V_L$ represents the signal 268, L represents an inductance associated with the inductive component 266, $T_{on}$ represents the duration of the on-time period of the transistor 250 or the transistor 252, and $I_{peak}$ represents a peak value of the lamp current 298.

According to Equation 7, because the inductance associated with the inductive component 266 is fixed, the lamp current 298 is regulated by adjusting the signal 268, in some embodiments. For example, shortly after the lamp 202 is successfully ignited and the lamp power has not reached the threshold, the signal 433 has a low magnitude (e.g., close to the chip-ground voltage 219). In another example, the signal 435 is determined by the signal 268 (e.g., $V_L$), and the control signal 297 is thus determined by the signal 268 (e.g., $V_L$). Therefore, the signal 268 (e.g., $V_L$) is used to regulate the lamp current 298 when the lamp power has not reached the threshold shortly after the lamp 202 is successfully ignited, according to certain embodiments.

In yet another embodiment, if the signal 435 is larger than the reference signal 419 in magnitude, then it indicates the lamp power has reached the threshold. Thus, the switch 427 is closed (e.g., on) and the duration of the on-time period of the transistor 250 or the transistor 252 is reduced according to certain embodiments. On the other hand, for example, if the signal 435 is smaller than the reference signal 419 in magnitude, then it indicates the lamp power has not reached the threshold. Thus, the switch 427 is open (e.g., off), and the duration of the on-time period (e.g., $T_{on}$) of the transistor 250 or the transistor 252 is increased according to some embodiments.

Figure 5:
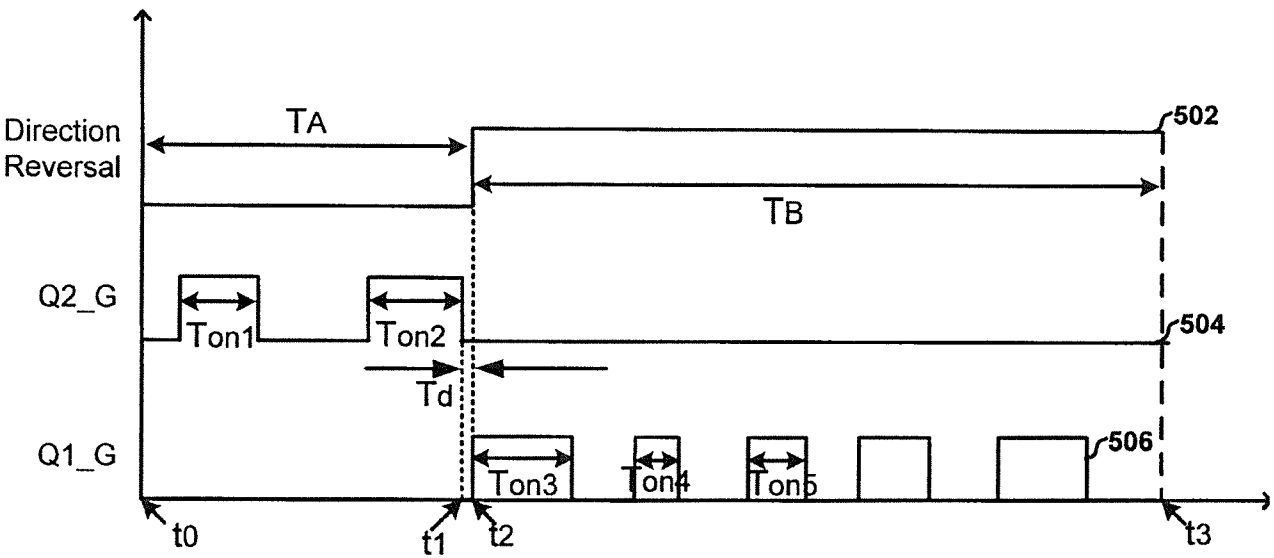
FIG. 5 is a simplified timing diagram for the system shown in FIG. 2 with current-reversal control after successful ignition according to an embodiment of the present invention.

FIG. 5 is a simplified timing diagram for the system 200 with current-reversal control after successful ignition according to an embodiment of the present invention. This diagram is merely an example, which should not unduly limit the scope of the claims. One of ordinary skill in the art would recognize many variations, alternatives, and modifications. The waveform 502 represents the current-reversal signal 246 as a function of time, the waveform 504 represents the signal 290 as a function of time, and the waveform 506 represents the signal 288 as a function of time.

Referring back to FIG. 4, shortly after the lamp 202 is successfully ignited, the lamp power is less than the threshold, in some embodiments. For example, when the current-reversal signal 246 changes from a logic high level to a logic low level or from the logic low level to the logic high level, the lamp voltage 244 changes polarity, and the lamp current 298 changes direction. In another example, the duration of the on-time period (e.g., $T_{on}$) of the transistor 250 or the transistor 252 increases up to a maximum value (e.g., $T_{on_max}$). Thus, after several switching cycles of the transistor 250 or the transistor 252, the lamp current 298 may increases to a large magnitude which may cause current overshoot to the lamp 202, the transistor 250 and/or the transistor 252, according to certain embodiments. For example, the increase of the lamp current 298 may cause voltage spikes additionally.

To ameliorate such a current overshoot and/or voltage spikes, a soft current reversal control is implemented in some embodiments. For example, shortly after the lamp 202 is successfully ignited, the current-reversal signal 246 is at the logic low level during a time period $T_A$ (e.g., between time $t_0$ and time $t_2$) as shown by the waveform 502. In another example, the transistor 252 is turned on and off in response to the signal 290 during the time period $T_A$ (e.g., as shown by the waveform 504). In yet another example, the duration of the on-time period of the transistor 252 in different switching cycles increases over time (e.g., $T_{on2}$ is longer than $T_{on1}$ as shown by the waveform 504) to increase the lamp current 298 in magnitude. In yet another example, during the time period $T_A$, the transistor 250 is kept off.

In one embodiment, when the current-reversal signal 246 changes from the logic low level to the logic high level (e.g., at $t_2$), the lamp current 298 changes direction and the lamp voltage 244 changes polarity. For example, during a time period $T_B$ (e.g., between the time $t_2$ and time $t_3$), the transistor 250 is turned on and off in response to the signal 288, and the transistor 252 is kept off. In another example, the duration of the on-time period of the transistor 250 is not limited during a first switching cycle after the current-reversal signal 246 changes from the logic low level to the logic high level (e.g., at $t_2$) in order to achieve quick current reversal. That is, the on-time period $T_{on3}$ is increased up to the maximum value (e.g., $T_{on_max}$) in some embodiments.

According to one embodiment, in order to ameliorate the current overshoot and/or voltage spikes that occur shortly after the lamp 202 is successfully ignited, the maximum on-time period values for several switching cycles following the first switching cycle are reduced. For example, during each of several switching cycles following the switching cycle, the on-time period of the transistor 250 in the switching cycle reaches a maximum value for that particular switching cycle. However, because of the decrease of the maximum values, the on-time periods of the transistor 250 in the switching cycles following the first switching cycle (e.g., $T_{on4}$ and $T_{on5}$) are no longer than the on-time period of the first switching cycle (e.g., $T_{on3}$) according to certain embodiments. For example, the on-time periods of the transistor 250 in the switching cycles following the first switching cycle gradually increase over time (e.g., $T_{on5}$ is longer than $T_{on4}$ as shown by the waveform 506).

In yet another embodiment, when the current-reversal signal 246 is at the logic low level, the current 298 flows in one direction (e.g., flows from the lamp 202 to the transformer 208), and the transistor 252 operates (e.g., being turned on or off) while the transistor 250 is off. For example, when the current-reversal signal 246 is at the logic high level, the current 298 flows in another direction (e.g., from the transformer 208 to the lamp 202), and the transistor 250 operates (e.g., being turned on or off) while the transistor 252 is off. In another example, a delay (e.g., $T_d$) is added between the time at which the transistor 252 is turned off in response to the signal 290 (e.g., at $t_1$ as shown by the waveform 504) and the time at which the current-reversal signal 246 changes from the logic low level to the logic high level (e.g., at $t_2$ as shown by the waveform 502). In yet another example, the delay (e.g., $T_d$) is used to prevent a current flowing through both the transistors 250 and 252 when the current-reversal signal 246 changes from the logic low level to the logic high level.

As discussed above and further emphasized here, FIG. 5 is merely examples, which should not unduly limit the scope of the claims. One of ordinary skill in the art would recognize many variations, alternatives, and modifications. For example, a waveform that represents the signal 284 (e.g., PWM) as a function of time (e.g., between the time $t_0$ and the time $t_3$) is divided into part of the waveform 504 (e.g., between the time $t_0$ and the time $t_2$) and part of the waveform 506 (e.g., between the time $t_2$ and the time $t_3$) as modified by the delay (e.g., $T_d$). In another example, a delay is added between the time at which the transistor 250 is turned off in response to the signal 288 and the time at which the current-reversal signal 246 changes from the logic high level to the logic low level to prevent a current flowing through both the transistors 250 and 252 when the current-reversal signal 246 changes from the logic high level to the logic low level. In yet another example, during the on-time period of the transistor 250 or the transistor 252, the signal 284 (e.g., PWM) is at a logic high level, and during the off-time period of the transistor 250 or the transistor 252, the signal 284 (e.g., PWM) is at a logic low level. In yet another example, during the on-time period of the transistor 250 or the transistor 252, the signal 284 (e.g., PWM) is at the logic low level, and during the off-time period of the transistor 250 or the transistor 252, the signal 284 (e.g., PWM) is at the logic high level.

Figure 6:
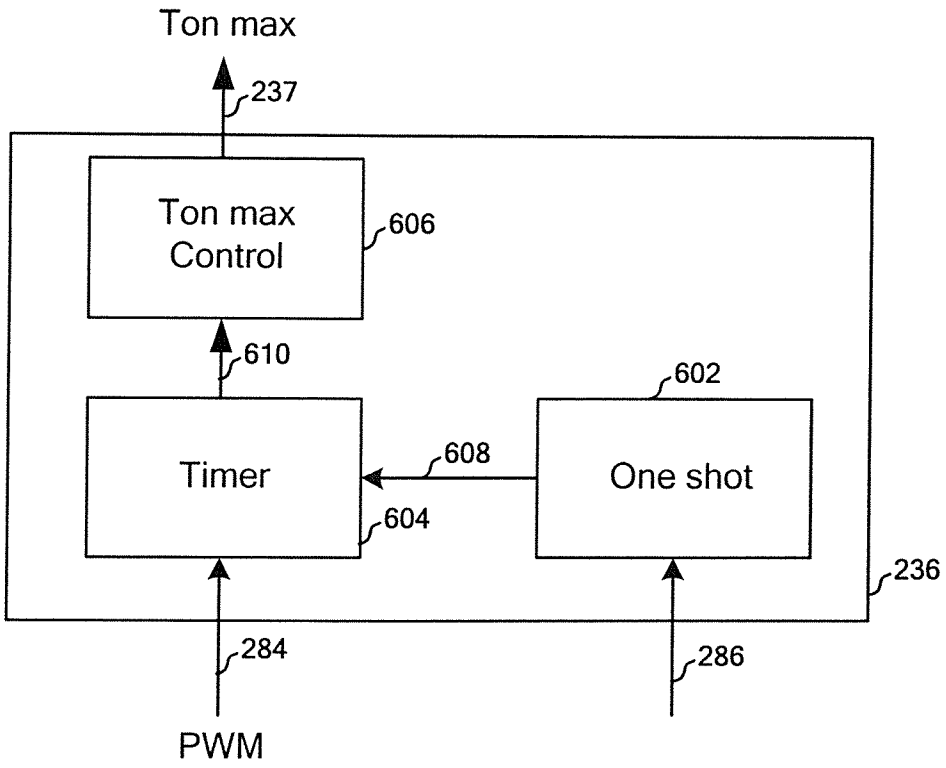
FIG. 6 is a simplified diagram showing certain components of the soft-on-time-max control component as part of the system shown in FIG. 2 for on-time period adjustment according to an embodiment of the present invention.

FIG. 6 is a simplified diagram showing certain components of the soft-on-time-max control component 236 as part of the system 200 for on-time period adjustment according to an embodiment of the present invention. This diagram is merely an example, which should not unduly limit the scope of the claims. One of ordinary skill in the art would recognize many variations, alternatives, and modifications. The soft-on-time-max control component 236 includes an one-shot component 602, a timer component 604, and an on-time-max controller 606.

The soft-on-time-max control component 236 adjusts the maximum value of the on-time period of the transistor 250 or the transistor 252 during a time period from the successful ignition of the lamp 202 to when the lamp power becomes stable according to certain embodiments. For example, the timer component 604 receives the signal 284 which determines switching periods of the transistors 250 and 252, and outputs a signal 610 to the on-time-max controller 606 which outputs the on-time-max signal 237 to the logic control component 228. In another example, the one-shot component 602 receives the signal 286 which is related to the current-reversal signal 246 and if the current 298 changes directions, outputs a pulse signal 608 to the timer component 604 which changes the signal 610. In yet another example, the on-time-max controller 606 in response changes the on-time-max signal 237 in order to adjust the maximum value of the on-time period of the transistor 250 or the transistor 252. The timer component 604 receives the signal 248 instead of the signal 284 in one embodiment. The one-shot component 602 receives the signal 246 instead of the signal 286 in another embodiment.

According to another embodiment, a system for igniting one or more high-intensity-discharge lamps includes an ignition controller configured to generate one or more signal pulses for a pulse signal during a first predetermined time period and to cause one or more voltage pulses to be applied to the one or more high-intensity-discharge lamps, the pulse signal changing between a first logic level and a second logic level during the first predetermined time period, each of the one or more signal pulses corresponding to a pulse period, the pulse period being no larger than the first predetermined time period. The ignition controller is further configured to, if the one or more high-intensity-discharge lamps are not successfully ignited after the first predetermined time period, stop generating any signal pulse for the pulse signal for a second predetermined time period, the second predetermined time period being equal to or larger than the pulse period. For example, the system is implemented according to at least FIG. 2 and/or FIG. 3.

According to yet another embodiment, a system for igniting one or more high-intensity-discharge lamps includes an ignition controller and a logic controller. The ignition controller is configured to generate one or more signal pulses for a pulse signal during a first predetermined time period and to cause one or more voltage pulses to be applied to the one or more high-intensity-discharge lamps, the pulse signal changing between a first logic level and a second logic level during the first predetermined time period, each of the one or more signal pulses corresponding to a pulse period, the pulse period being no larger than the first predetermined time period. The logic controller is configured to generate one or more direction pulses for a direction signal during the first predetermined time period to change a direction for a current associated with the one or more high-intensity-discharge lamps, the direction signal changing between a third logic level and a fourth logic level during the first predetermined time period. The direction signal changes from the third logic level to the fourth logic level at the same time as the pulse signal changes from the second logic level to the first logic level. The direction signal changes from the fourth logic level to the third logic level at the same time as the pulse signal changes from the second logic level to the first logic level. For example, the system is implemented according to at least FIG. 2 and/or FIG. 3.

According to yet another embodiment, a system for driving one or more high-intensity-discharge lamps includes a regulation component and a controller component. The regulation component is configured to receive an input signal indicating a power associated with the one or more high-intensity-discharge lamps and generate a first signal based on at least information associated with the input signal. The controller component is configured to receive the first signal and a second signal indicating a voltage associated with the one or more high-intensity-discharge lamps. The regulation component is further configured to generate an output signal based on at least information associated with the first signal and the second signal in order to adjust a current associated with the one or more high-intensity-discharge lamps. For example, the system is implemented according to at least FIG. 2 and/or FIG. 4.

According to yet another embodiment, a system for driving one or more high-intensity-discharge lamps includes a logic component and a controller component. The logic component is configured to output a direction signal to change a direction for a current associated with the one or more high-intensity-discharge lamps and to output a modulation signal associated with a plurality of on-time periods. The controller component is configured to receive at least the direction signal and generate an output signal to the logic component based on at least information associated with the direction signal. Further, if the direction signal changes from a first logic level to a second logic level at a first time, the logic component is further configured to change the modulation signal based on at least information associated with the output signal to adjust one or more on-time periods after the first time, the one or more on-time periods after the first time increasing in duration over time. For example, the system is implemented according to at least FIG. 2, FIG. 5 and/or FIG. 6.

In one embodiment, a method for igniting one or more high-intensity-discharge lamps includes generating one or more signal pulses for a pulse signal during a first predetermined time period, the pulse signal changing between a first logic level and a second logic level during the first predetermined time period, each of the one or more signal pulses corresponding to a pulse period, the pulse period being no larger than the first predetermined time period. The method further includes processing information associated with the one or more signal pulses for the pulse signal, causing one or more voltage pulses to be applied to the one or more high-intensity-discharge lamps, and if the one or more high-intensity-discharge lamps are not successfully ignited after the first predetermined time period, stopping generating any signal pulse for the pulse signal for a second predetermined time period, the second predetermined time period being equal to or larger than the pulse period. For example, the method is implemented according to at least FIG. 2 and/or FIG. 3.

In another embodiment, a method for igniting an ignition one or more high-intensity-discharge lamps includes generating one or more signal pulses for a pulse signal during a first predetermined time period, the pulse signal changing between a first logic level and a second logic level during the first predetermined time period, each of the one or more signal pulses corresponding to a pulse period, the pulse period being no larger than the first predetermined time period. The method further includes causing one or more voltage pulses to be applied to the one or more high-intensity-discharge lamps, and generating one or more direction pulses for a direction signal during the first predetermined time period to change a direction for a current associated with the one or more high-intensity-discharge lamps, the direction signal changing between a third logic level and a fourth logic level during the first predetermined time period. Additionally, the method includes changing the pulse signal from the second logic level to the first logic level at the same time as the direction signal changes from the third logic level to the fourth logic level, and changing the pulse signal from the second logic level to the first logic level at the same time as the direction signal changes from the fourth logic level to the third logic level. For example, the method is implemented according to at least FIG. 2 and/or FIG. 3.

In yet another embodiment, a method for driving one or more high-intensity-discharge lamps includes receiving an input signal indicating a power associated with the one or more high-intensity-discharge lamps, processing information associated with the input signal, and generating a first signal based on at least information associated with the input signal. The method further includes receiving the first signal and a second signal indicating a voltage associated with the one or more high-intensity-discharge lamps, processing information associated with the first signal and the second signal, and generating an output signal based on at least information associated with the first signal and the second signal in order to adjust a current associated with the one or more high-intensity-discharge lamps. For example, the method is implemented according to at least FIG. 2 and/or FIG. 4.

In yet another embodiment, a method for driving one or more high-intensity-discharge lamps includes generating a direction signal to change a direction for a current associated with the one or more high-intensity-discharge lamps, generating a modulation signal associated with a plurality of on-time periods, and receiving at least the direction signal. In addition, the method includes processing information associated with the direction signal, generating an output signal based on at least information associated with the direction signal, and if the direction signal changes from a first logic level to a second logic level at a first time, changing the modulation signal based on at least information associated with the output signal to adjust one or more on-time periods after the first time, the one or more on-time periods after the first time increasing in duration over time. For example, the system is implemented according to at least FIG. 2, FIG. 5 and/or FIG. 6.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for driving one or more high-intensity-discharge lamps, the system comprising:

a regulation component configured to receive an input signal indicating a power associated with the one or more high-intensity-discharge lamps and generate a first signal based on at least information associated with the input signal;

a controller component configured to receive the first signal and a second signal indicating a voltage associated with the one or more high-intensity-discharge lamps, wherein the controller component is further configured to generate an output signal based on at least information associated with the first signal and the second signal in order to adjust a current associated with the one or more high-intensity-discharge lamps; and a gate driver configured to:

receive the output signal changing between a first logic level and a second logic level;

if the output signal is at the first logic level, cause the current associated with the one or more high-intensity-discharge lamps to flow in a first direction; and if the output signal is at the second logic level, cause the current associated with the one or more high-intensity-discharge lamps to flow in a second direction, the second direction being different from the first direction.

2. The system of claim 1, and further comprising:

a first transistor; and a second transistor;

wherein:

the gate driver is further configured to generate a first gate drive signal and a second gate drive signal based on at least information associated with the output signal;

the first transistor is configured to be turned on or off in response to the first gate drive signal;

the second transistor is configured to be turned on or off in response to the second gate drive signal;

if the output signal is at the first logic level, the first transistor is further configured to be turned on to cause the current associated with the one or more high-intensity-discharge lamps to flow in the first direction; and if the output signal is at the second logic level, the second transistor is further configured to be turned on to cause the current associated with the one or more high-intensity-discharge lamps to flow in the second direction.

3. The system of claim 2 wherein:

the second transistor is further configured to be turned off when the current associated with the one or more high-intensity-discharge lamps flows in the first direction; and the first transistor is further configured to be turned off when the current associated with the one or more high-intensity-discharge lamps flows in the second direction.

4. The system of claim 2 wherein:

during a first on-time period when the first transistor is turned on, the current associated with the one or more high-intensity-discharge lamps increases in magnitude.

5. The system of claim 4 wherein:

during a second on-time period when the second transistor is turned on, the current associated with the one or more high-intensity-discharge lamps increases in magnitude.

6. The system of claim 5 wherein if the input signal indicates that the power associated with the one or more high-intensity-discharge lamps is lower than a threshold, the controller component is further configured to change the output signal in order to increase the power based on at least information associated with the second signal.

7. The system of claim 6 wherein if the input signal indicates that the power associated with the one or more high-intensity-discharge lamps is lower than the threshold, the controller component is further configured to change the output signal to increase the first on-time period until the first on-time period reaches a first maximum value.

8. The system of claim 7 wherein if the input signal indicates that the power associated with the one or more high-intensity-discharge lamps is lower than the threshold, the controller component is further configured to change the output signal to increase the second on-time period until the second on-time period reaches a second maximum value.

9. The system of claim 8 wherein the regulation component includes:

an amplifier configured to receive a third signal associated with the input signal and output the first signal based on at least information associated with the third signal;

wherein:

if the power associated with the one or more high-intensity-discharge lamps is lower than the threshold, the amplifier is further configured to change the first signal to a first magnitude.

10. The system of claim 9 wherein the first magnitude is close to zero.

11. The system of claim 8 wherein the controller component includes:

a combination component configured to receive the first signal and the second signal and generate a combined signal based on at least information associated with the first signal and the second signal; and a comparator configured to receive the combined signal and a reference signal and generate the output signal based on at least information associated with the combined signal and the reference signal.

12. The system of claim 11 wherein the combined signal is related to a logic sum of the first signal and the second signal.

13. The system of claim 1 wherein the input signal indicates an output current of a power stage, the output current of the power stage being related to the power associated with the one or more high-intensity-discharge lamps.

14. The system of claim 13 wherein the system is configured to regulate the power associated with the one or more high-intensity-discharge lamps by adjusting the output current of the power stage.

15. A system for driving one or more high-intensity-discharge lamps, the system comprising:

a logic component configured to output a direction signal to change a direction for a current associated with the one or more high-intensity-discharge lamps and to output a modulation signal associated with a plurality of on-time periods; and a controller component configured to receive at least the direction signal and generate an output signal to the logic component based on at least information associated with the direction signal;

wherein if the direction signal changes from a first logic level to a second logic level at a first time, the logic component is further configured to change the modulation signal based on at least information associated with the output signal to adjust one or more on-time periods after the first time, the one or more on-time periods after the first time increasing in duration over time.

16. The system of claim 15 wherein the logic component is further configured not to adjust a first on-time period that follows immediately the first time.

17. The system of claim 16 wherein the logic component is further configured to increase in duration the one or more on-time periods after the first time until a second on-time period among the one or more on-time periods reaches a maximum value in duration.

18. The system of claim 17 wherein the first on-time period that follows immediately the first time is equal in duration to the maximum value.

19. The system of claim 15 wherein the controller component includes:

a signal generator configured to receive the direction signal and generate a detection signal based on at least information associated with the direction signal;

a timer component configured to receive the modulation signal and the detection signal and generate a timing signal based on at least information associated with the modulation signal and the detection signal; and an on-time control component configured to receive the timing signal and generate the output signal based on at least information associated with the timing signal.

20. The system of claim 15 wherein the logic component is further configured to keep the modulation signal at a third logic level during an on-time period.

21. The system of claim 20 wherein the logic component is further configured to keep the modulation signal at a fourth logic level for a predetermined time period and then change the direction signal from the first logic level to the second logic level.

22. A method for driving one or more high-intensity-discharge lamps, the method comprising:

receiving an input signal indicating a power associated with the one or more high-intensity-discharge lamps;

processing information associated with the input signal;

generating a first signal based on at least information associated with the input signal;

receiving the first signal and a second signal indicating a voltage associated with the one or more high-intensity-discharge lamps;

processing information associated with the first signal and the second signal; and generating an output signal based on at least information associated with the first signal and the second signal in order to adjust a current associated with the one or more high-intensity-discharge lamps;

receiving the output signal changing between a first logic level and a second logic level;

if the output signal is at the first logic level, causing the current associated with the one or more high-intensity-discharge lamps to flow in a first direction; and if the output signal is at the second logic level, causing the current associated with the one or more high-intensity-discharge lamps to flow in a second direction, the second direction being different from the first direction.

23. A method for driving one or more high-intensity-discharge lamps, the method comprising:

generating a direction signal to change a direction for a current associated with the one or more high-intensity-discharge lamps;

generating a modulation signal associated with a plurality of on-time periods;

receiving at least the direction signal;

processing information associated with the direction signal;

generating an output signal based on at least information associated with the direction signal; and if the direction signal changes from a first logic level to a second logic level at a first time, changing the modulation signal based on at least information associated with the output signal to adjust one or more on-time periods after the first time, the one or more on-time periods after the first time increasing in duration over time.

* * * * *